US009406259B2

(12) United States Patent
Ma

(10) Patent No.: US 9,406,259 B2
(45) Date of Patent: Aug. 2, 2016

(54) PIXEL CIRCUITS, OR+GANIC ELECTROLUMINESCENT DISPLAY PANELS AND DISPLAY DEVICES

(71) Applicant: BOE TECHNOLOGY GROUP CO., LTD., Beijing (CN)

(72) Inventor: Zhanjie Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 263 days.

(21) Appl. No.: 14/359,165

(22) PCT Filed: May 10, 2013

(86) PCT No.: PCT/CN2013/075509

§ 371 (c)(1),
(2) Date: May 19, 2014

(87) PCT Pub. No.: WO2014/134869

PCT Pub. Date: Sep. 12, 2014

(65) Prior Publication Data

US 2015/0310804 A1 Oct. 29, 2015

(30) Foreign Application Priority Data

Mar. 6, 2013 (CN) ..... 2013 1 0070460

(51) Int. Cl.
*G09G 3/32* (2016.01)

(52) U.S. Cl.
CPC ..... *G09G 3/3241* (2013.01); *G09G 3/3208* (2013.01); *G09G 3/3233* (2013.01); (Continued)

(58) Field of Classification Search
CPC .. G09G 3/3208; G09G 3/3241; G09G 3/3233
See application file for complete search history.

(56) References Cited

U.S. PATENT DOCUMENTS

2011/0157135 A1 6/2011 Lee et al.
2011/0221791 A1 9/2011 Kajiyama et al.

(Continued)

FOREIGN PATENT DOCUMENTS

CN 101339737 A 1/2009
CN 102117598 A 7/2011

(Continued)

OTHER PUBLICATIONS

Second Chinese Office Action dated Feb. 28, 2015; Appln. No. 201310070460.7.

(Continued)

*Primary Examiner* — Kent Chang
*Assistant Examiner* — Chayce Bibbee
(74) *Attorney, Agent, or Firm* — Ladas & Parry LLP

(57) ABSTRACT

A pixel circuit, an organic electroluminescent display panels and a display device is configured to improve image brightness uniformity in the displaying region of the display device. The pixel circuit comprises a capacitor (CST), a light emitting device (D1), a driving control sub-module (1), a charging and resetting sub-module (2), and a light-emitting control sub-module (3). A first terminal of the capacitor (CST) serves as a first node (A), and a second terminal of the capacitor (CST) servers as a second node (B). A first terminal (x) of the light emitting device (D1) is connected to a fifth terminal (e') of the light emitting control sub-module (3), and a second terminal (y) of the light emitting device is connected to a second reference signal terminal (Vref2). When the charging and resetting sub-module (2) is turned on, the data signal is written to the first node (A), and the first terminal and third terminal of the driving control sub-module (2) are shorted, which can reset the voltage of the second node (B) and charge the capacitor (CST). When the light emitting control sub-module (3) is turned on, the driving control sub-module (1) and the light emitting device (D1) are connected and the light emitting device (D1) is driven to emit light.

20 Claims, 5 Drawing Sheets

(52) U.S. Cl.
CPC ..... *G09G2300/0819* (2013.01); *G09G 2300/0842* (2013.01); *G09G 2300/0861* (2013.01); *G09G 2300/0866* (2013.01); *G09G 2320/045* (2013.01)

(56) References Cited

U.S. PATENT DOCUMENTS

| | | | |
|---|---|---|---|
| 2012/0235972 | A1 | 9/2012 | Liu et al. |
| 2014/0049169 | A1 | 2/2014 | Li et al. |

FOREIGN PATENT DOCUMENTS

| | | | |
|---|---|---|---|
| CN | 102194408 | A | 9/2011 |
| CN | 102222465 | A | 10/2011 |
| CN | 102881253 | A | 1/2013 |
| CN | 102881255 | A | 1/2013 |
| CN | 102930820 | A | 2/2013 |
| CN | 102930824 | A | 2/2013 |
| CN | 203085137 | A | 7/2013 |

OTHER PUBLICATIONS

International Preliminary Report on Patentability issued Sep. 8, 2015; PCT/CN2013/075509.

Fourth Chinese Office Action dated Jan. 5, 2015; Appln. No. 201310070460.7.

First Chinese Office Action dated Sep. 3, 2014; Appln. No. 201310070460.7.

International Search Report mailed Dec. 12, 2013; PCT/CN2013/075509.

Third Chinese Office Action Appln. No. 201310070460.7; Dated Jun. 30, 2015.

PIXEL CIRCUITS, ORGANIC ELECTROLUMINESCENT DISPLAY PANELS AND DISPLAY DEVICES

TECHNICAL FIELD

Embodiments of the invention relate to pixel circuits, organic electroluminescent display panels and display devices.

BACKGROUND

Organic light emitting diode (OLED) display devices are becoming attractive due to their advantages such as low power consumption, high lightness, low cost, wide viewing angle and quick response speed and so on, and are widely used in the organic light emitting field.

In OLED display devices, there are following problems. Firstly, transistors for achieving image display on a backplane lack of uniformity in their structures, electrical properties and stability, which causes the threshold voltages $V_{th}$ shifts of transistors. Secondly, in a case where the transistors are turned on for a long period of time, the stability of the transistors decreases. In addition, as OLEDs are increased by size during development, loads on signal lines become large, which results in a voltage attenuation on the signal lines, such as changes of operation voltages.

When the OLED is driven to work by a conventional pixel circuit for driving the OLED to emit light, current flowing through the OLED depends on at least one of factors including the threshold voltage $V_{th}$ of the driving transistors, the stability of driving transistors and a reference voltage $V_{ref}$. When each pixel is applied by a same driving signal, in a displaying region of the backplane, the currents flowing through the OLEDs are not equal to each other, which results in the non-uniformity of the currents on the backplane and thus the non-uniformity of the brightness in the image.

SUMMARY

An embodiment of the invention provides a pixel circuit comprising a light emitting device, a capacitor, a driving control sub-module, a charging and resetting sub-module and a light emitting control sub-module, wherein a first terminal of the capacitor as a first node is connected to a first terminal of the charging and resetting sub-module and a first terminal of the light emitting control sub-module respectively, a second terminal of the capacitor as a second node is connected to a second terminal of the charging and resetting sub-module and a first terminal of the driving control sub-module respectively; a second terminal of the driving control sub-module is connected to a first reference signal terminal, a third terminal of the driving control sub-module is connected to a third terminal of the charging and resetting sub-module and a second terminal of the light emitting control sub-module respectively, the driving control sub-module is controlled by the second node to drive the light emitting device to emit light; a fourth terminal of the charging and resetting sub-module is connected to a data signal terminal, a fifth terminal of the charging and resetting sub-module is connected to a gate signal terminal, the charging and resetting sub-module is controlled by the gate signal terminal to transmit data signal from the data signal terminal; and a third terminal of the light emitting control sub-module is connected to a light emitting signal, a fourth terminal of the light emitting control sub-module is connected to the first reference signal terminal, a fifth terminal of the light emitting control sub-module is connected to a first terminal of the light emitting device, and a second terminal of the light emitting is connected to the second reference terminal, the light emitting control sub-module serves to drive the light emitting device to emit light under the controlling of the light emitting terminal.

Another embodiment of the invention provides an organic electroluminescent display panel comprising the above pixel circuit.

Another embodiment of the invention provides a display device comprising the above organic electroluminescent display panel.

BRIEF DESCRIPTION OF THE DRAWINGS

For better understanding technical solutions according to embodiments of the present invention, drawings of the embodiments will be described briefly below. Obviously, drawings in the following description only relate to some embodiments of the present invention, not for limiting the present invention.

DETAILED DESCRIPTION

In order to make the purpose, technology solution and advantages of embodiments of the present invention more clear, technology solutions according to embodiments of the present invention will be described clearly and completely below with respect to drawings of embodiments of the present invention. It is understood that the described embodiments are part of but not all of embodiments of the present invention. Based on the described embodiments of the present invention, all other embodiments obtained by those of ordinary skilled in the art without any creative labor fall into the protective scope of the present invention.

Embodiments of the invention provide pixel circuits, organic electroluminescent display panels and display devices for purpose of improving image brightness uniformity in the displaying region of the display device.

Hereinafter, the pixel circuits, the organic electroluminescent display panels and the display devices provided in the embodiments of the invention will be described in details with reference to the drawings.

Figure 1:
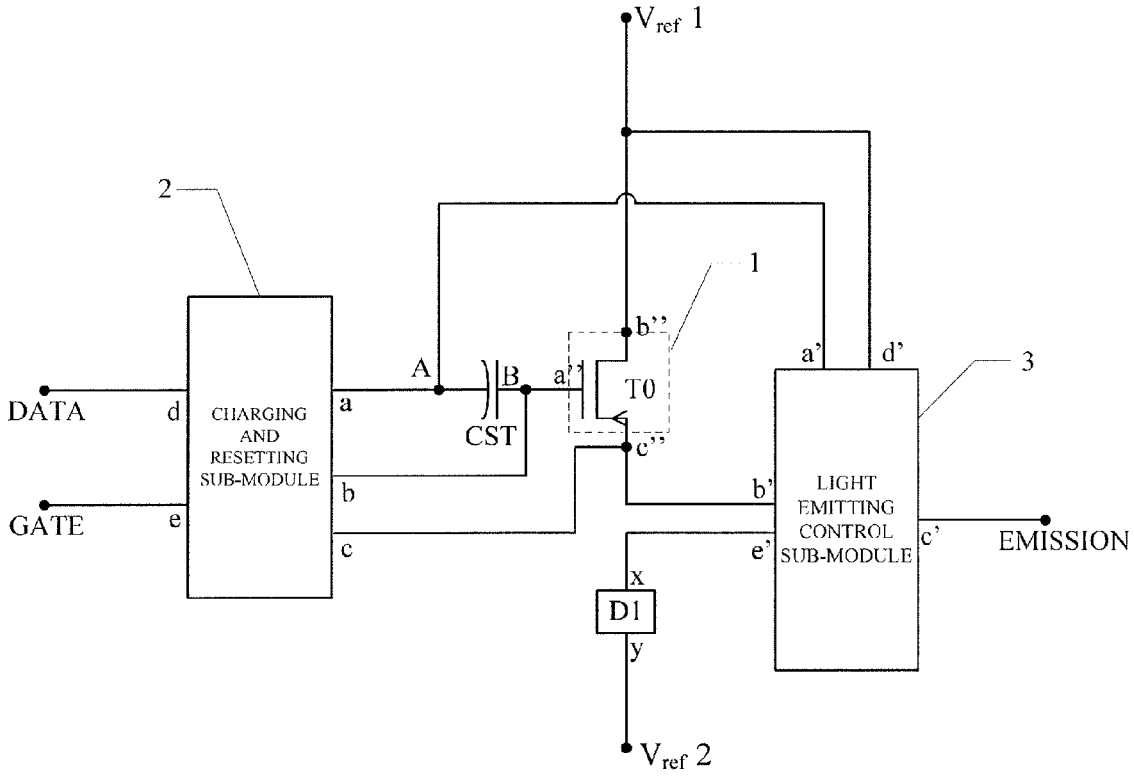
FIG. 1 is schematic view of an exemplary structure of pixel circuit provided in embodiments of the invention.

The embodiments of the invention provide a pixel circuit, as shown in FIG. 1. The pixel circuit comprises a light emitting device D1, a capacitor CST, a driving control sub-module 1, a charging and resetting sub-module 2 and a light emitting control sub-module 3.

In the embodiments of the invention, the capacitor CST has a first terminal as a first node A which is connected to a first terminal a of the charging and resetting sub-module 2 and a first terminal a' of the light emitting control sub-module 3, and a second terminal as a second node B which is connected to a second terminal b of the charging and resetting sub-module 2 and a first terminal a" of the driving control sub-module 1.

In the embodiments of the invention, a second terminal b" of the driving control sub-module 1 is connected to a first reference signal terminal $V_{ref}$ 1, a third terminal c" of the driving control sub-module 1 is connected to a third terminal c of the charging and resetting sub-module 2 and a second terminal b' of the light emitting control sub-module 3 respectively, and the driving control sub-module 1 is controlled by the second node B so as to drive the light emitting device D1 to emit light.

In the embodiments of the invention, a fourth terminal d of the charging and resetting sub-module 2 is connected to a data signal terminal DATA, a fifth terminal e of the charging and resetting sub-module 2 is connected to a gate signal terminal GATE, and the charging and resetting sub-module 2 is controlled by the gate signal terminal GATE so as to transmit a data signal from the data signal terminal DATA.

In the embodiments of the invention, a third terminal c' of the light emitting control sub-module 3 is connected to a light emitting signal terminal EMISSION, a fourth terminal d' of the light emitting control sub-module 3 is connected to the first reference signal terminal $V_{ref}$ 1, a fifth terminal e' of the light emitting sub-module 3 is connected to a first terminal x of the light emitting device D1, a second terminal y of the light emitting device D1 is connected to a second reference signal terminal $V_{ref}$ 2, and the light emitting control sub-module 3 is adapted to drive the light emitting device D1 to emit light under the control of the light emitting signal terminal EMISSION.

In the above pixel circuit provided in the embodiments of the invention, the signal received by the first reference signal terminal $V_{ref}$ 1 is direct current (DC) or alternate current (AC) signal, that is, the first reference signal terminal $V_{ref}$ 1 is connected to a DC signal source electrode or an AC signal source electrode; and the signal received by the second reference signal terminal $V_{ref}$ 2 is DC signal, that is, the second reference signal terminal $V_{ref}$ 2 is connected to a DC signal source electrode.

In the embodiments of the invention, when the first reference signal terminal $V_{ref}$ 1 outputs a DC voltage, the current for driving the light emitting device D1 to emit light depends on the DV voltage and the voltage $V_{DATA}$ of the data signal; and when the first reference signal terminal $V_{ref}$ 1 outputs an AC voltage, the current for driving the light emitting device D1 to emit light depends only on the voltage $V_{DATA}$ of the data signal. In both cases described above, the current for driving the light emitting device D1 to emit light does not depend on the threshold voltage $V_{th}$ of the driving transistor T1; therefore it is possible to prevent the light emitting device D1 from being affected by the threshold voltage $V_{th}$ of the driving transistor V0. In this case, even when the same data signals are applied to different pixel units, it is possible to obtain images having the same brightness, so as to improve image brightness uniformity in the displaying region of the display device.

It should be noted that, in the embodiments of the invention, the driving transistors and the switch transistors can be thin film transistors (TFTs), or metal oxide semiconductor field effect transistors (MOSFETs), and they can be N type transistors or P type transistors and are not limited hereto. Furthermore, in the embodiments of the invention, drain electrodes and source electrodes of these transistors can be exchanged and are not distinguished specifically from each other. In the description of the exemplary embodiments, both of the driving transistors and the switch transistors are thin film transistors (TFTs), and a terminal indicated with an arrow among the three electrodes of the TFT is drain electrode, for example.

In the above pixel circuit provided in the embodiments of the invention, for example, the driving control sub-module 1 can comprise the driving transistor T0. The gate electrode of the driving transistor T0 is connected to the second node B, the source electrode of the driving transistor T0 is connected to the first reference signal terminal $V_{ref}$ 1, and the drain electrode of the driving transistor T0 is connected to the second terminal b' of the light emitting control sub-module 3.

In the above pixel circuit provided in the embodiments of the invention, for example, the light-emitting device D1 can be an organic light emitting diode (OLED). In the embodiments of the invention, the light emitting device D1 can realize light emitting display under the ON-state current of the driving transistor T0.

Hereinafter, the operation principle of the above pixel circuit provided in the embodiments of the invention will be described briefly.

The operation procedure of the above pixel circuit provided in the embodiments of the invention can be divided into following two stages.

The first stage is a data writing stage. In this stage, the pixel circuit can implement data signal writing of the first node and also implement voltage resetting function of the second node. In this stage, the light-emitting control sub-module 3 is in an OFF state; the charging and resetting sub-module 2 is in an ON state, and the voltage $V_{DATA}$ of the data signal output from the data signal terminal DATA is applied to the first node A by the charging and resetting sub-module 2 so as to charge the capacitor CST. At the meantime, the charging and resetting sub-module 2 in the ON state shorts the drain electrode and the gate electrode of the driving transistor T0, and the storing of the threshold voltage $V_{th}$ of the driving transistor T0 at the second node B and resetting function for the second node B can be implemented.

The second stage is a light emitting stage. In this stage, the charging and resetting sub-module 2 is in an OFF state; the light emitting control sub-module 3 is in an ON state so that the first terminal x of the light-emitting device D1 and the drain electrode of the driving transistor T0 are connected, and the driving transistor T0 is turned on according to the voltage of the reference signal applied to the source electrode and the voltage corresponding to the discharging of the capacitor CST so as to drive the light-emitting device D1 to emit light.

Figure 2A:
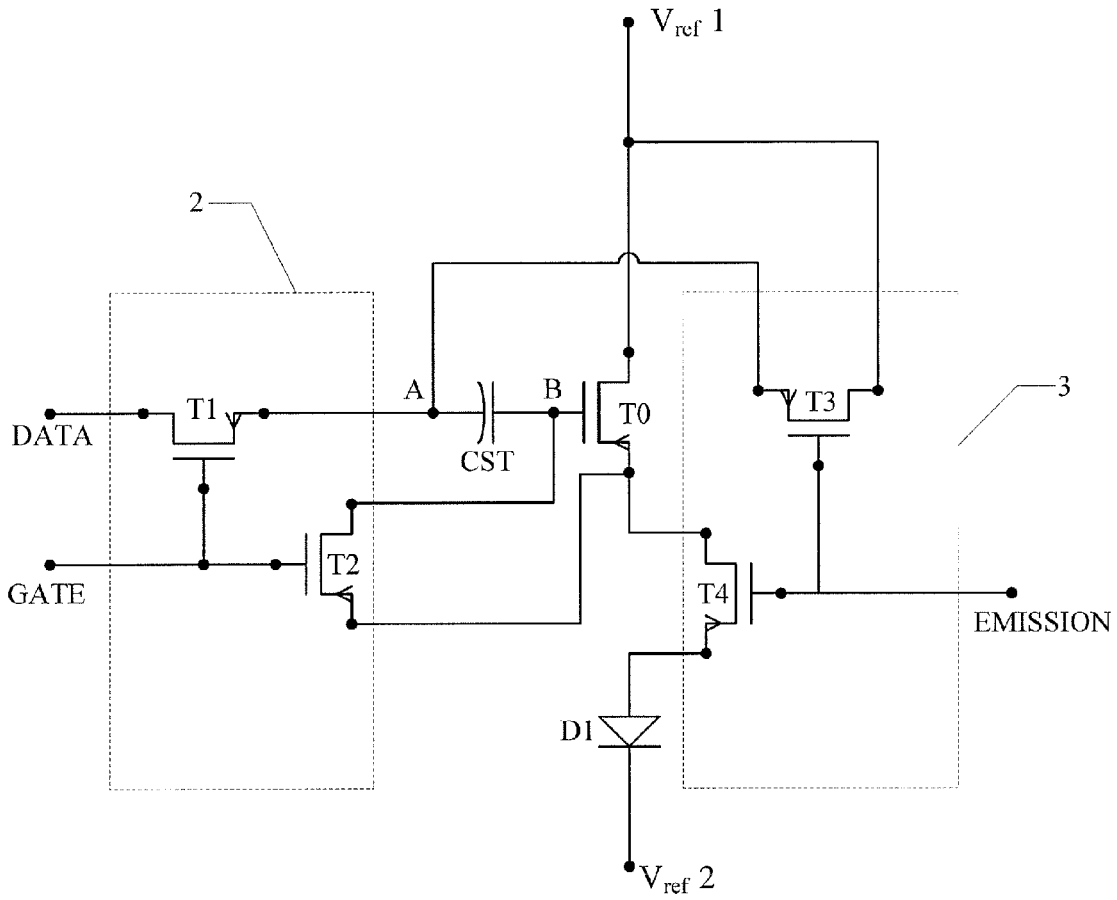
FIGS. 2*a* and 2*b* are schematic views of an exemplary structures of pixel circuit provided in embodiments of the invention respectively.

It should be noted that, in the embodiments of the invention, in case that the driving transistor T0 is a P-type transistor whose threshold voltage $V_{th}$ is a negative value, the voltage of the first reference signal terminal $V_{ref}$ 1 is greater than the voltage of the second reference signal terminal $V_{ref}$ 2. In this case, the positive electrode of the light emitting device D1 is the first terminal of the light-emitting device, and connected to the light-emitting control sub-module 3, as shown in FIG. 2*a*. In case that the driving transistor T0 is a N-type transistor whose threshold voltage $V_{th}$ is a positive value, the voltage of the first reference signal terminal $V_{ref}$ 1 is less than the voltage of the second reference signal terminal $V_{ref}$ 2. In this case, the negative electrode of the light-emitting device D1 is the first terminal of the light-emitting device, and connected to the light-emitting control sub-module 3 as shown in FIG. 2*b*.

Hereinafter, the exemplary structures and the operation principles of the charging and resetting sub-module 2 and the light-emitting sub-module 3 in the above pixel circuit provided in the embodiments of the invention will be described in details.

Figure 2B:
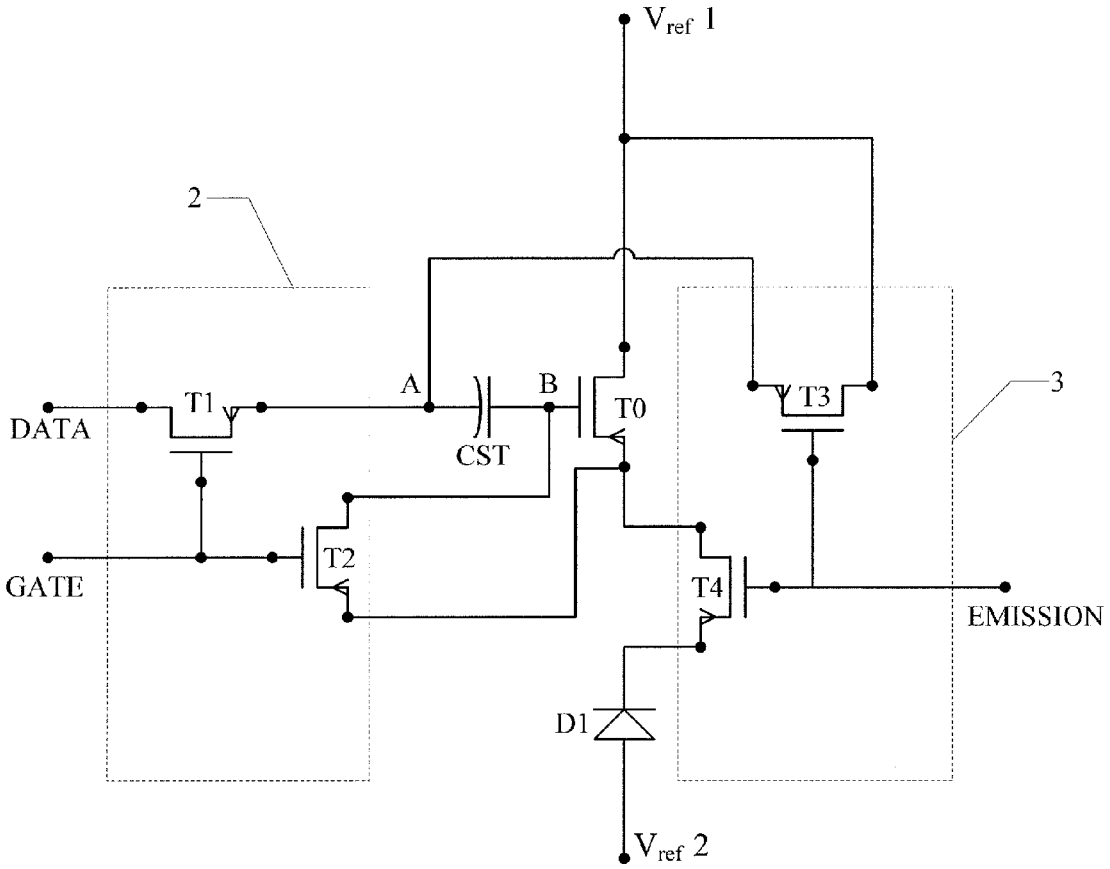

In the pixel circuit provided in the embodiments of the invention, as shown in FIGS. 2*a* and 2*b*, the charging and resetting sub-module 2 can comprise a first switch transistor T1 and a second switch transistor T2. In the embodiments of the invention, a gate electrode of the first switch transistor T1 is connected to the gate signal terminal GATE, a source electrode of the first switch transistor T1 is connected to the data signal terminal DATA, and a drain electrode of the first switch transistor T1 is connected to the first node A; a gate electrode of the second switch transistor T2 is connected to the gate signal terminal GATE, a source electrode of the second switch transistor T2 is connected to the second node B, and a drain electrode of the second switch transistor T2 is connected to the third terminal of the driving control sub-module 1, that is, the drain electrode of the driving transistor T0.

It should be noted that, in the embodiments of the invention, in case that the first switch transistor T1 and the second switch transistor T2 are P-type transistors, the gate electrodes thereof can only be turned on in a case where the gate signal terminal GATE outputs a low-level gate signal; and in case that the first switch transistor T1 and the second switch transistor T2 are N-type transistors, the gate electrodes thereof can only be turned on in a case where the gate signal terminal GATE outputs a high-level gate signal.

In the pixel circuit provided in the embodiments of the invention, as shown in FIGS. 2*a* and 2*b*, the light emitting control sub-module 3 can comprise a third switch transistor T3 and a fourth switch transistor T4. In the embodiments of the invention, a gate electrode of the third switch transistor T3 is connected to the light emitting signal terminal EMISSION, a source electrode of the third switch transistor T3 is connected to the first reference terminal $V_{ref}$ 1, and a drain electrode of the third switch transistor T3 is connected to the first node A; a gate electrode of the fourth switch transistor T4 is connected to the light emitting signal terminal EMISSION, a source electrode of the fourth switch transistor T4 is connected to the third terminal of the driving control sub-module 1, that is, the drain electrode of the driving transistor T0, and a drain electrode of the fourth switch transistor T4 is connected to the first terminal of the light emitting device D1.

It should be noted that, in the embodiments of the invention, in case that the third switch transistor T3 and the fourth switch transistor T4 are P-type transistors, the gate electrodes thereof can be only turned on in a case where the light emitting signal terminal EMISSION outputs a low-level light emitting signal; and in case that the third switch transistor T3 and the fourth switch transistor T4 are N-type transistors, the gate electrodes thereof can be only turned on in a case where the light emitting signal terminal EMISSION outputs a high-level light emitting signal.

Hereinafter, the operation principle of the pixel circuit provided in the embodiments of the invention will be described in more details in some operation states of the pixel circuit.

Figure 3A:
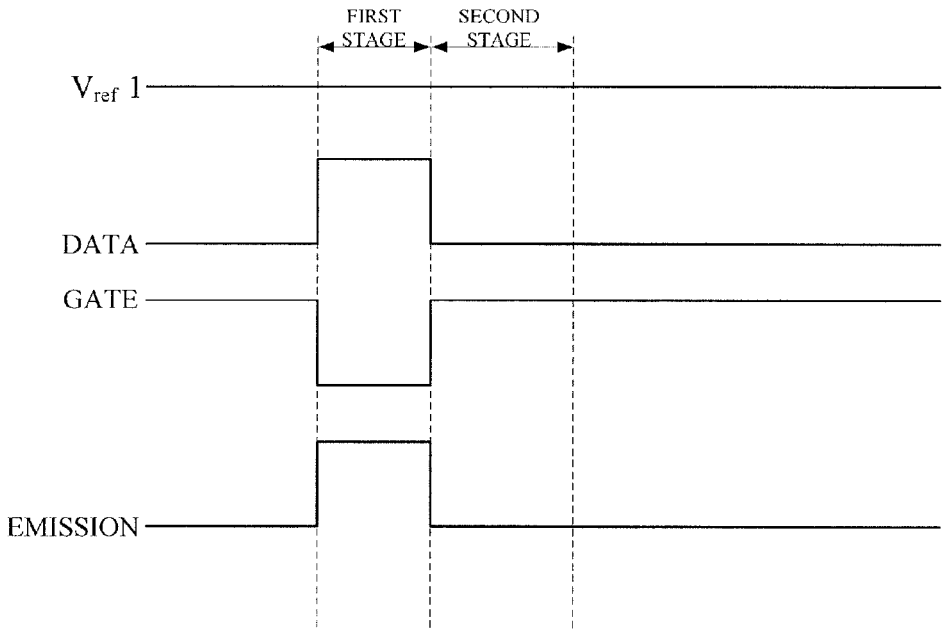
FIGS. 3*a* to 3*d* are circuit timing charts of the pixel circuits provided in the embodiments of the invention respectively.

When the reference signal received by the first reference signal terminal $V_{ref}$ 1 is a DC signal and the driving transistor T0, the first switch transistor T1, the second switch transistor T2, the third switch transistor T3, and the fourth switch transistor T3 are P-type transistors, the reference signal output by the first reference signal terminal $V_{ref}$ 1 is a high-level signal, the reference signal output by the second reference signal terminal $V_{ref}$ 2 is a low-level signal, and the circuit signal timing chart of the pixel circuit is as shown in FIG. 3*a*. In this case, the operation principle of the pixel is as follows.

In the data writing stage of the pixel circuit, i.e. the first stage, the gate signal output by the gate signal terminal GATE turns on the gate electrode of the first switch transistor T1 so that the first switch transistor T1 is connected in a way acting as a diode, and the voltage of the data signal output by the data signal terminal DATA is written to the first node A connected to the drain electrode of the first switch transistor T1 through the source electrode of the first switch transistor T1, that is to say, the voltage of the first node A becomes $V_{DATA}$, thereby the data writing of the first node A is implemented. The gate signal output by the gate signal terminal GATE also turns on the gate electrode of the second switch transistor T2 so that the second switch transistor T2 is connected in a way acting as a diode so as to connect the drain electrode and the gate electrode of the driving transistor T0. Since the driving transistor T0 is a P-type transistor with a negative threshold voltage $V_{th}$, and the voltage value of the DC signal of the first reference signal terminal $V_{ref}$ 1 is $V_m$, the voltage of the second node B becomes $V_m+V_{th}$, thereby the storing of the threshold voltage $V_{th}$ of the second node B and the resetting function for the second node B are implemented.

In the light emitting stage of the pixel circuit, i.e. the second stage, the light emitting signal output by the light emitting terminal EMISSION turns on the gate electrode of the third switch transistor T3 so that the third switch transistor T3 is connected in a way acting as a diode, and thus the voltage of the first node A becomes $V_m$ which is the same as the voltage of the first reference signal terminal $V_{ref}$ 1. The voltage of the second node B becomes $V_m-V_{DATA}+V_m+V_{th}=2V_m-V_{DATA}+V_{th}$ correspondingly based on the capacitance charge conservation principle. In this case, the voltage difference between the source electrode and the gate electrode of the driving transistor T0 is $V_{gs}=V_g-V_s=2V_m-V_{DATA}+V_{th}-V_m=V_m-V_{DATA}+V_{th}$.

Since the driving transistor T0 is operated in a saturation state, based on the current characteristic in the saturation state, it can be known that the on-state current $i_d$ of the driving transistor T0 follows a formula as below:

$$i_d = \frac{K}{2}(V_{gs} - V_{th})^2 = \frac{K}{2}(V_m - V_{DATA} + V_{th} - V_{th})^2 = \frac{K}{2}(V_m - V_{DATA})^2,$$

where K is a structure parameter which is relatively stable in the same structure and can be considered as a constant value. It can be derived from the formula that the on-state current $i_d$ flowing through the driving transistor T0 depends only on the voltage $V_{DATA}$ of the data signal and the voltage $V_m$ of the first reference signal terminal $V_{ref}$ 1, and does not depend on the threshold voltage $V_{th}$ of the driving transistor T0. Therefore, by using the on-state current $i_d$ of the driving transistor T0 to drive the light emitting devices D1 to emit light, the currents flowing through the OLEDs do not vary due to non-uniformity of $V_{th}$ caused by the manufacturing process of the backplane, thus avoiding brightness variation. Meanwhile, in the embodiments of the invention, the change of the current flowing through the light emitting device D1 and accordingly the change of the brightness, which can result in the degeneration of the stability of the light emitting device D1, due to the degeneration of $V_{th}$, can also be improved.

Figure 3B:
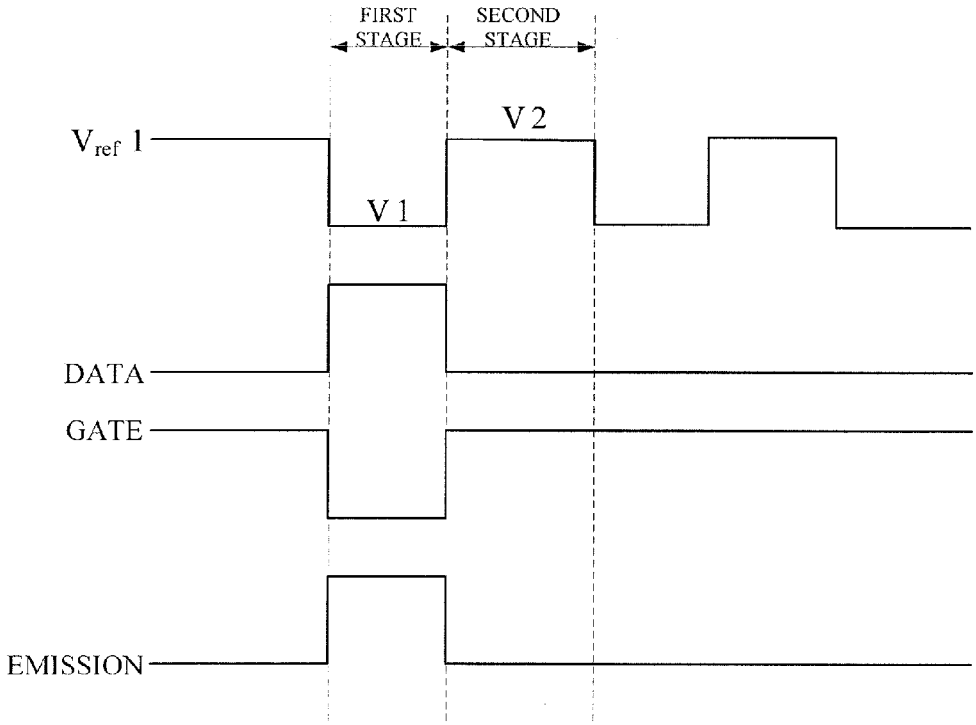

If the reference signal received by the first reference signal terminal $V_{ref}$ 1 is an AC signal and the driving transistor T0, the first switch transistor T1, the second switch transistor T2, the third switch transistor T3, and the fourth switch transistor T3 are P-type transistors, the reference signal output by the second reference signal terminal $V_{ref}$ 2 is a low-level signal, and the circuit signal timing chart of the pixel circuit is as shown in FIG. 3*b*. In this case, the operation principle of the pixel circuit is as follows.

In the data writing stage of the pixel circuit, i.e. the first stage, the gate signal output by the gate signal terminal GATE turns on the gate electrode of the first switch transistor T1 so that the first switch transistor T1 is connected in a way acting as a diode, and the data signal output by the data signal terminal DATA is written to the first node A connected to the drain electrode of the first switch transistor T1 through the source electrode of the first switch transistor T1, that is to say, the voltage of the first node A becomes $V_{DATA}$, thereby the data writing of the first node A is implemented. The gate signal output by the gate signal terminal GATE also turns on the gate electrode of the second switch transistor T2 so that the second switch transistor T2 is connected in a way acting as a diode so as to connect the drain electrode and the gate electrode of the driving transistor T0. Since the driving transistor T0 is a P-type transistor with a negative threshold voltage $V_{th}$ and the voltage of the first reference signal terminal $V_{ref}$1 is $V_1$, the voltage of the second node B becomes $V_1+V_{th}$, thereby the storing of the threshold voltage $V_{th}$ of the second node B and the resetting function for the second node B are implemented.

In the light emitting stage of the pixel circuit, i.e. the second stage, the voltage of the first reference signal terminal $V_{ref}$1 becomes $V_2$ and $V_2>V_1$, the light emitting signal output by the light emitting terminal EMISSION turns on the gate electrode of the third switch transistor T3 so that the third switch transistor T3 is connected in a way acting as a diode, and thus the voltage of the first node A becomes $V_2$ which is the same as the voltage of the first reference signal terminal $V_{ref}$1 and the voltage of the second node B becomes $V_2-V_{DATA}+V_1+V_{th}$ correspondingly based on the capacitance charge conservation principle. In this case, the voltage difference between the source electrode and the gate electrode of the driving transistor T0 is $V_{gs}=V_g-V_s=V_2-V_{DATA}+V_1+V_{th}-V_2=V_1-V_{DATA}+V_{th}$.

Since the driving transistor T0 operates in a saturation state, based on the current characteristic in the saturation state, it can be known that the on-state current $i_d$ of the driving transistor T0 follows the formula as below:

$$i_d = \frac{K}{2}(V_{gs} - V_{th})^2 = \frac{K}{2}(V_1 - V_{DATA} + V_{th} - V_{th})^2 = \frac{K}{2}(V_1 - V_{DATA})^2,$$

where K is a structure parameter which is relatively stable in the same structure and can be considered as a constant value. In the embodiments of the invention, in general, the voltage $V_1$ output by the first reference signal terminal $V_{ref}$1 is 0V. Therefore, it can be derived from the formula that the on-state current $i_d$ flowing through the driving transistor T0 depends only on the voltage $V_{DATA}$ of the data signal and does not depend on the threshold voltage $V_{th}$ of the driving transistor T0 and the reference signal. Therefore, by using the on-state current $i_d$ of the driving transistor T0 to drive the light emitting devices D1 to emit light, the currents flowing through the OLEDs do not vary due to non-uniformity of $V_{th}$ caused by the manufacturing process of the backplane, thus avoiding brightness variation. Meanwhile, the change of the current flowing through the light emitting device D1 and accordingly the change of the lightness, which can result in the degeneration of the stability of the light emitting device D1, due to the degeneration of $V_{th}$, can also be improved. Further, in the embodiments of the invention, the displaying problem due to the current variation, which is caused by the IR drop of $V_{ref}$1 introduced by the load on the $V_{ref}$1 signal line, is also alleviated.

Figure 3C:
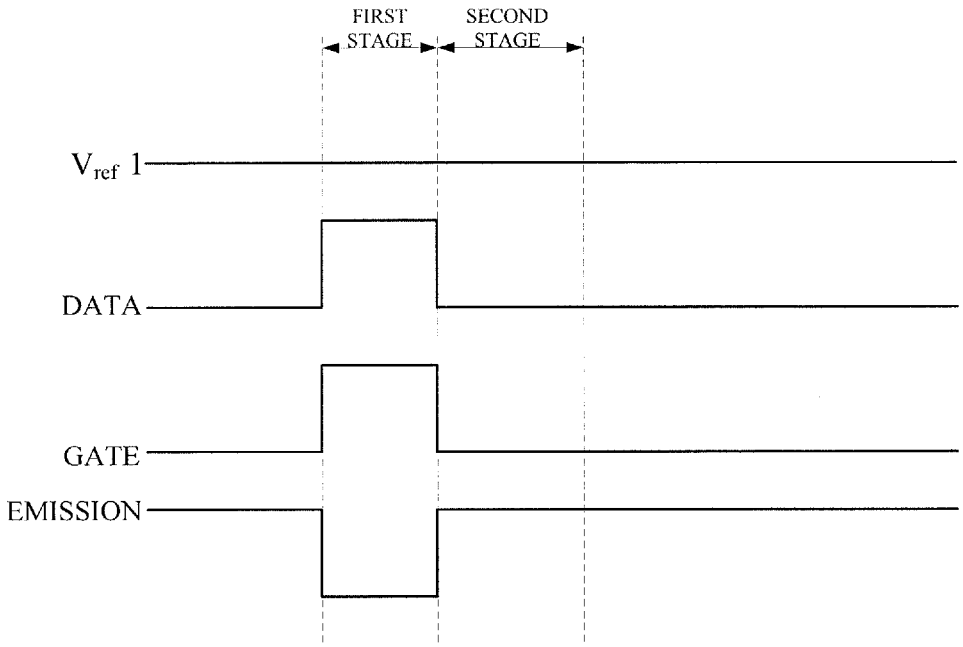

If the reference signal received by the first reference signal terminal $V_{ref}$1 is a DC signal and the driving transistor T0, the first switch transistor T1, the second switch transistor T2, the third switch transistor T3, and the fourth switch transistor T3 are N-type transistors, the circuit signal timing chart of the pixel circuit is as shown in FIG. 3*c* and the reference signal output by the first reference signal terminal $V_{ref}$1 is a low-level signal, the reference signal output by the second reference signal terminal $V_{ref}$2 is a high-level signal. In this case, the operation principle of the pixel circuit is as follows.

In the data writing stage of the pixel circuit, i.e. the first stage, the gate signal output by the gate signal terminal GATE turns on the gate electrode of the first switch transistor T1 so that the first switch transistor T1 is connected in a way acting as a diode, and the voltage of the data signal output by the data signal terminal DATA is written to the first node A connected to the drain electrode of the first switch transistor T1 through the source electrode of the first switch transistor T1, that is to say, the voltage of the first node A becomes $V_{DATA}$, thereby the data writing of the first node A is implemented. The gate signal output by the gate signal terminal GATE also turns on the gate electrode of the second switch transistor T2 so that the second switch transistor T2 is connected in a way acting as a diode to connect the drain electrode and the gate electrode of the driving transistor T0. Since the driving transistor T0 is a N-type transistor with a positive threshold voltage $V_{th}$ and the voltage value of the DC signal of the first reference signal terminal $V_{ref}$ 1 is $V_n$, the voltage at the second node B becomes $V_n+V_{th}$, thereby the storing of the threshold voltage $V_{th}$ at the second node B and the resetting function for the second node B are implemented.

In the light emitting stage of the pixel circuit, i.e. the second stage, the light emitting signal output by the light emitting terminal EMISSION turns on the gate electrode of the third switch transistor T3 so that the third switch transistor T3 is connected in a way acting as a diode, and thus the voltage of the first node A become Vn which is the same as the voltage of the first reference signal terminal $V_{ref}$1 and the voltage of the second node B becomes $V_n-V_{DATA}+V_n+V_{th}=2V_n-V_{DATA}+V_{th}$ correspondingly based on the capacitance charge conservation principle. In this case, the voltage difference between the source electrode and the gate electrode of the driving transistor T0 is $V_{gs}=V_g-V_s=2V_n-V_{DATA}+V_{th}-V_n-V_n-V_{DATA}+V_{th}$.

Since the driving transistor T0 operates in a saturation state, based on the current characteristic in the saturation state, it can be known that the on-state current $i_d$ of the driving transistor T0 follows the formula as below:

$$i_d = \frac{K}{2}(V_{gs} - V_{th})^2 = \frac{K}{2}(V_n - V_{DATA} + V_{th} - V_{th})^2 = \frac{K}{2}(V_n - V_{DATA})^2,$$

where K is a structure parameter which is relatively stable in the same structure and can be considered as a constant value. It can be derived from the formula that the on-state current $i_d$ flowing through the driving transistor T0 depends only on the voltage $V_{DATA}$ of the data signal and the voltage $V_n$ of the first reference signal terminal, and does not depend on the threshold voltage $V_{th}$ of the driving transistor T0. Therefore, by using the on-state current $i_d$ of the driving transistor T0 to drive the light emitting devices D1 to emit light, the currents flowing through the OLEDs do not vary due to non-uniformity of $V_{th}$ caused by the manufacturing process of the backplane, thus avoiding brightness variation. Meanwhile, the change of the current flowing through the light emitting device D1 and accordingly the change of the lightness, which can result in the degeneration of the stability of the light emitting device D1, due to the degeneration of $V_{th}$, can also be improved.

Figure 3D:
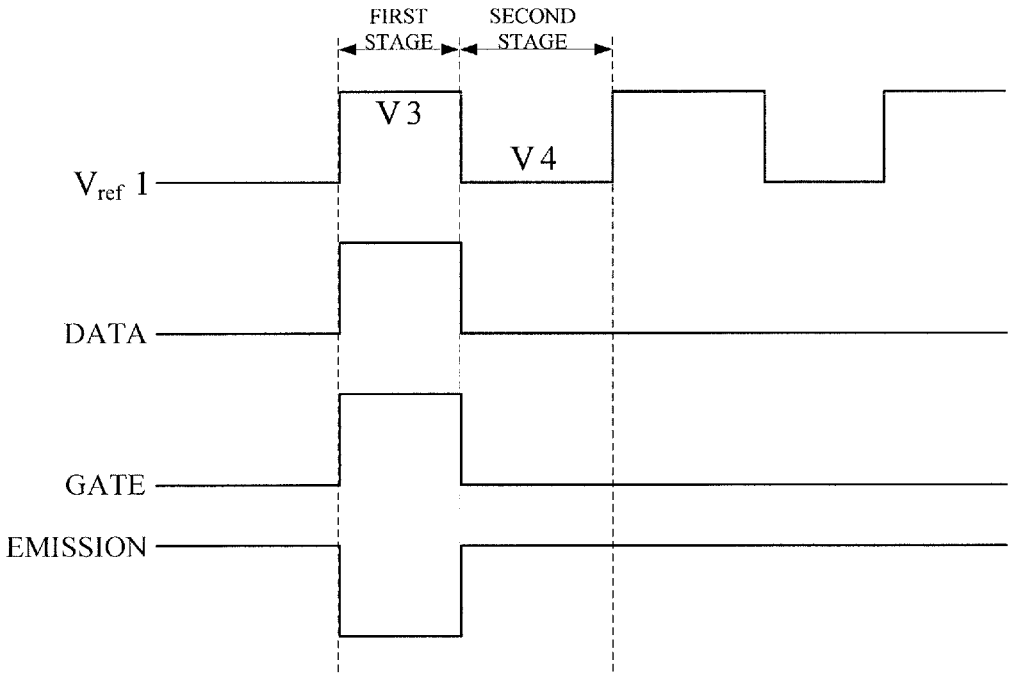

When the reference signal received by the first reference signal terminal $V_{ref}$1 is an AC signal and the driving transistor T0, the first switch transistor T1, the second switch transistor T2, the third switch transistor T3, and the fourth switch transistor T3 are N-type transistors, the reference signal output by the second reference signal terminal $V_{ref}$ 2 is a high-level signal, and the circuit signal timing chart of the pixel circuit is as shown in FIG. 3*d*. In this case, the operation principle of the pixel circuit is as follows.

In the data writing stage of the pixel circuit, i.e. the first stage, the gate signal output by the gate signal terminal GATE turns on the gate electrode of the first switch transistor T1 so that the first switch transistor T1 is connected in a way acting as a diode, and the voltage of the data signal output by the data signal terminal DATA is written to the first node A connected to the drain electrode of the first switch transistor T1 through the source electrode of the first switch transistor T1, that is to say, the voltage of the first node A becomes $V_{DATA}$, thereby the data writing of the first node A is implemented. The gate signal output by the gate signal terminal GATE also turns on the gate electrode of the second switch transistor T2 so that the second switch transistor T2 is connected in a way acting as a diode so as to connect the drain electrode and the gate electrode of the driving transistor T0. Since the driving transistor T0 is a N-type transistor with a positive threshold voltage $V_{th}$ and the voltage of the first reference signal terminal $V_{ref}$ 1 is $V_3$, the voltage of the second node B becomes $V_3+V_{th}$, thereby the storing of the threshold voltage $V_{th}$ at the second node B and the resetting function for the second node B are implemented.

In the light emitting stage of the pixel circuit, i.e. the second stage, the voltage of the first reference signal terminal $V_{ref}$ 1 becomes $V_4$ and $V_4>V_3$, the light emitting signal output by the light emitting terminal EMISSION turns on the gate electrode of the third switch transistor T3 so that the third switch transistor T3 is connected in a way acting as a diode, and thus the voltage at the first node A become $V_4$ which is the same as the voltage of the first reference signal terminal $V_{ref}$1 and the voltage of the second node B becomes $V_4-V_{DATA}+V_3+V_{th}$ correspondingly based on the capacitance charge conservation principle. In this case, the voltage difference between the source electrode and the gate electrode of the driving transistor T0 is $V_{gs}=V_g-V_s=V_4-V_{DATA}+V_3+V_{th}-V_4=V_3-V_{DATA}+V_{th}$.

Since the driving transistor T0 operates in a saturation state, based on the current characteristic in the saturation state, it can be known that the on-state current $i_d$ of the driving transistor T0 follows the formula as below:

$$i_d = \frac{K}{2}(V_{gs} - V_{th})^2 = \frac{K}{2}(V_3 - V_{DATA} + V_{th} - V_{th})^2 = \frac{K}{2}(V_3 - V_{DATA})^2,$$

where K is a structure parameter which is relatively stable in the same structure and can be considered as a constant value. In the embodiments of the invention, in general, the voltage $V_3$ output by the first reference signal terminal $V_{ref}$ 1 is 0V. Therefore, it can be derived from the formula that the on-state current $i_d$ flowing through the driving transistor T0 depends only on the voltage $V_{DATA}$ of the data signal and does not depend on the threshold voltage $V_{th}$ of the driving transistor T0 and the reference signal. Therefore, by using the on-state current $i_d$ of the driving transistor T0 to drive the light emitting devices D1 to emit light, the currents flowing through the OLEDs do not vary due to non-uniformity of $V_{th}$ caused by the manufacturing process of the backplane, thus avoiding brightness variation. Meanwhile, the change of the current flowing through the light emitting device D1 and accordingly the change of the lightness, which can result in the degeneration of the stability of the light emitting device D1, due to the degeneration of $V_{th}$, can also be improved. Further, in the embodiments of the invention, the displaying problem due to the current variation, which is caused by the IR drop of $V_{ref}$1 introduced by the load on the $V_{ref}$1 signal line, is also alleviated.

Based on the same inventive concept, the embodiments of the invention also provide an organic electroluminescent display panel comprising the above pixel circuit provided in the embodiments of the invention. Since the operation principle and the principle for solving the problem of the organic electroluminescent display panel provided in the embodiments of the invention are similar as those described for the pixel circuit, the organic electroluminescent display panel can be implemented with reference to the pixel circuit, and the repetitive description will be omitted.

Based on the same inventive concept, the embodiments of the invention also provide a display device comprising the above pixel circuit provided in the embodiments of the invention. The display device provided in the embodiments of the invention can be a display apparatus, mobile phone, television, notebook computer, all-in-one machine or the like, and the other parts of the display device are not described here since they are well known by those skilled in the art and are not intended to limit the invention.

As described above, the embodiments of the invention provide a pixel circuit, an organic electroluminescent display panel comprising the pixel circuit and a display device comprising the organic electroluminescent display panel. The pixel circuit comprises a capacitor, a light emitting device, a driving control sub-module, a charging and resetting sub-module and a light emitting control sub-module. A first terminal of the capacitor acting as a first node is connected to a first terminal of the charging and resetting sub-module and a first terminal of the light emitting control sub-module respectively, a second terminal of the capacitor acting as a second node is connected to a second terminal of the charging and resetting sub-module and a first terminal of the driving control sub-module respectively; a second terminal of the driving control sub-module is connected to a first reference signal terminal, a third terminal thereof is connected to a third terminal of the charging and resetting sub-module and a second terminal of the light emitting control sub-module respectively; a first terminal of the light emitting device is connected to a fifth terminal of the light emitting control sub-module, a second terminal thereof is connected to a second reference signal terminal. When the charging and resetting sub-module is turned on, the data signal output by the data signal terminal is written to the first node, and the first terminal and third terminal of the charging and resetting sub-module are shorted, which can reset the voltage of the second node and charge the capacitor. When the light emitting control sub-module is turned on, the driving control sub-module and the light emitting device are connected to drive the light emitting device to emit light. When the first reference signal terminal outputs a DC voltage, the current for driving the light emitting device to emit light depends on the voltage of the data signal; and when the first reference signal terminal outputs an AC voltage, the current for driving the light emitting device to emit light depends only on the voltage of the data signal. In both cases, the current for driving the light emitting device to emit light does not depend on the threshold voltage of the driving transistor in the driving control sub-module, so it is possible to prevent the light emitting device from being affected by the threshold voltage. Therefore, even when the same data signals are applied to different pixel units, it is possible to obtain an image with uniform brightness, so as to improve image brightness uniformity in the displaying region of the display device.

It should be noted that the above embodiments are only for the purpose of describing technical proposal of the present invention rather than limiting it. While the present invention has been described in detail with reference to the above-mentioned embodiments, those of ordinary skill in the art should understand that they can modify the technical solution recorded in the above embodiments or conduct equivalent substitution for a part of technical features thereof and these modifications or substitutions will not make the nature of respective technical solution to depart from the spirit and scope of technical solutions of embodiments of the present invention.

The invention claimed is:

1. A pixel circuit comprising a light emitting device, a capacitor, a driving control sub-module, a charging and resetting sub-module and a light emitting control sub-module, wherein a first terminal of the capacitor as a first node is connected to a first terminal of the charging and resetting sub-module and a first terminal of the light emitting control sub-module respectively, a second terminal of the capacitor as a second node is connected to a second terminal of the charging and resetting sub-module and a first terminal of the driving control sub-module respectively;

a second terminal of the driving control sub-module is connected to a first reference signal terminal, a third terminal of the driving control sub-module is connected to a third terminal of the charging and resetting sub-module and a second terminal of the light emitting control sub-module respectively, the driving control sub-module is controlled by the second node to drive the light emitting device to emit light;

a fourth terminal of the charging and resetting sub-module is connected to a data signal terminal, a fifth terminal of the charging and resetting sub-module is connected to a gate signal terminal, the charging and resetting sub-module is controlled by the gate signal terminal to transmit data signals from the data signal terminal; and a third terminal of the light emitting control sub-module is connected to a light emitting signal terminal, a fourth terminal of the light emitting control sub-module is connected to the first reference signal terminal, a fifth terminal of the light emitting control sub-module is connected to a first terminal of the light emitting device, and a second terminal of the light emitting device is connected to a second reference terminal, the light emitting control sub-module is adapted to drive the light emitting device to emit light under the control of the light emitting signal terminal.

2. The pixel circuit of claim 1, wherein a signal received by the first reference signal terminal is a DC signal or an AC signal.

3. The pixel circuit of claim 1, wherein a signal received by the second reference signal terminal is a DC signal.

4. The pixel circuit of claim 1, wherein the driving control sub-module comprises a driving transistor, and the driving transistor has a gate electrode connected to the second node, a source electrode connected to the first reference signal terminal, and a drain electrode connected to the second terminal of the light emitting control sub-module.

5. The pixel circuit of claim 1, wherein the charging and resetting sub-module comprises a first switch transistor and a second switch transistor, and the first switch transistor has a gate electrode connected to the gate signal terminal, a source electrode connected to the data signal terminal, and a drain electrode connected to the first node; and the second switch transistor has a gate electrode connected to the gate signal terminal, a source electrode connected to the second node, and a drain electrode connected to the third terminal of the driving control sub-module.

6. The pixel circuit of claim 1, wherein the light emitting control sub-module comprises a third switch transistor and a fourth switch transistor, and wherein the third switch transistor has a gate electrode connected to the light emitting signal terminal, a source electrode connected to the first reference signal terminal, and a drain electrode connected to the first node; and the fourth switch transistor has a gate electrode connected to the light emitting signal terminal, a source electrode connected to the third terminal of the driving control sub-module, and a drain electrode connected to the first terminal of the light emitting device.

7. The pixel circuit of claim 4, wherein in case that the driving transistor is a P-type transistor, the voltage of the first reference signal terminal is greater than the voltage of the second reference signal terminal; and in case that the driving transistor is a N-type transistor, the voltage of the first reference signal terminal is less than the voltage of the second reference signal terminal.

8. An organic electroluminescent display panel comprising a pixel circuit comprising a light emitting device, a capacitor, driving control sub-module, a charging and resetting sub-module and a light emitting control sub-module, wherein a first terminal of the capacitor as a first node is connected to a first terminal of the charging and resetting sub-module and a first terminal of the light emitting control sub-module respectively, a second terminal of the capacitor as a second node is connected to a second terminal of the charging and resetting sub-module and a first terminal of the driving control sub-module respectively;

a second terminal of the driving control sub-module is connected to a first reference signal terminal, a third terminal of the driving control sub-module is connected to a third terminal of the charging and resetting sub-module and a second terminal of the light emitting control sub-module respectively, the driving control sub-module is controlled by the second node to drive the light emitting device to emit light;

a fourth terminal of the charging and resetting sub-module is connected to a data signal terminal, a fifth terminal of the charging and resetting sub-module is connected to a gate signal terminal, the charging and resetting sub-module is controlled by the gate signal terminal to transmit data signals from the data signal terminal; and a third terminal of the light emitting control sub-module is connected to a light emitting signal terminal, a fourth terminal of the light emitting control sub-module is connected to the first reference signal terminal, a fifth terminal of the light emitting control sub-module is connected to a first terminal of the light emitting device, and a second terminal of the light emitting device is connected to a second reference terminal, the light emitting control sub-module is adapted to drive the light emitting device to emit light under the control of the light emitting signal terminal.

9. A display device comprising an organic electroluminescent display panel comprising a pixel circuit comprising a light emitting device, a capacitor, a driving control sub-module, a charging and resetting a sub-module and a light emitting control sub-module, wherein a first terminal of the capacitor as a first node is connected to a first terminal of the charging and resetting sub-module and a first terminal of the light emitting control sub-module respectively, a second terminal of the capacitor as a second node is connected to a second terminal of the charging and resetting sub-module and a first terminal of the driving control sub-module respectively;

a second terminal of the driving control sub-module is connected to a first reference signal terminal, a third terminal of the driving control sub-module is connected to a third terminal of the charging and resetting sub-module and a second terminal of the light emitting control sub-module respectively, the driving control sub-module is controlled by the second node to drive the light emitting device to emit light;

a fourth terminal of the charging and resetting sub-module is connected to a data signal terminal, a fifth terminal of the charging and resetting sub-module is connected to a gate signal terminal, the charging and resetting sub-module is controlled by the gate signal terminal to transmit data signals from the data signal terminal; and a third terminal of the light emitting control sub-module is connected to a light emitting signal terminal, a fourth terminal of the light emitting control sub-module is connected to the first reference signal terminal, a fifth terminal of the light emitting control sub-module is connected to a first terminal of the light emitting device, and a second terminal of the light emitting device is connected to a second reference terminal, the light emitting control sub-module is adapted to drive the light emitting device to emit light under the control of the light emitting signet terminal.

10. The pixel circuit of claim 3, wherein the charging and resetting sub-module comprises a first switch transistor and a second switch transistor, and the first switch transistor has a gate electrode connected to the gate signal terminal, a source electrode connected to the data signal terminal, and a drain electrode connected to the first node; and the second switch transistor has a gate electrode connected to the gate signal terminal, a source electrode connected to the second node, and a drain electrode connected to the third terminal of the driving control sub-module.

11. The pixel circuit of claim 4, wherein the charging and resetting sub-module comprises a first switch transistor and a second switch transistor, and the first switch transistor has a gate electrode connected to the gate signal terminal, a source electrode connected to the data signal terminal, and a drain electrode connected to the first node; and the second switch transistor has a gate electrode connected to the gate signal terminal, a source electrode connected to the second node, and a drain electrode connected to the third terminal of the driving control sub-module.

12. The pixel circuit of claim 3, wherein the light emitting control sub-module comprises a third switch transistor and a fourth switch transistor, and wherein the third switch transistor has a gate electrode connected to the light emitting signal terminal, a source electrode connected to the first reference signal terminal, and a drain electrode connected to the first node; and the fourth switch transistor has a gate electrode connected to the light emitting signal terminal, a source electrode connected to the third terminal of the driving control sub-module, and a drain electrode connected to the first terminal of the light emitting device.

13. The pixel circuit of claim 4, wherein the light emitting control sub-module comprises a third switch transistor and a fourth switch transistor, and wherein the third switch transistor has a gate electrode connected to the light emitting signal terminal, a source electrode connected to the first reference signal terminal, and a drain electrode connected to the first node; and the fourth switch transistor has a gate electrode connected to the light emitting signal terminal, a source electrode connected to the third terminal of the driving control sub-module, and a drain electrode connected to the first terminal of the light emitting device.

14. The pixel circuit of claim 5, wherein the light emitting control sub-module comprises a third switch transistor and a fourth switch transistor, and wherein the third switch transistor has a gate electrode connected to the light emitting signal terminal, a source electrode connected to the first reference signal terminal, and a drain electrode connected to the first node; and the fourth switch transistor has a gate electrode connected to the light emitting signal terminal, a source electrode connected to the third terminal of the driving control sub-module, and a drain electrode connected to the first terminal of the light emitting device.

15. The pixel circuit of claim 10, wherein the light emitting control sub-module comprises a third switch transistor and a fourth switch transistor, and wherein the third switch transistor has a gate electrode connected to the light emitting signal terminal, a source electrode connected to the first reference signal terminal, and a drain electrode connected to the first node; and the fourth switch transistor has a gate electrode connected to the light emitting signal terminal, a source electrode connected to the third terminal of the driving control sub-module, and a drain electrode connected to the first terminal of the light emitting device.

16. The organic electroluminescent display panel of claim 8, wherein the driving control sub-module comprises a driving transistor, and the driving transistor has a gate electrode connected to the second node, a source electrode connected to the first reference signal terminal, and a drain electrode connected to the second terminal of the light emitting control sub-module.

17. The organic electroluminescent display panel of claim 8, wherein the charging and resetting sub-module comprises a first switch transistor and a second switch transistor, and the first switch transistor has a gate electrode connected to the gate signal terminal, a source electrode connected to the data signal terminal, and a drain electrode connected to the first node; and the second switch transistor has a gate electrode connected to the gate signal terminal, a source electrode connected to the second node, and a drain electrode connected to the third terminal of the driving control sub-module.

18. The organic electroluminescent display panel of claim 8, wherein the light emitting control sub-module comprises a third switch transistor and a fourth switch transistor, and wherein the third switch transistor has a gate electrode connected to the light emitting signal terminal, a source electrode connected to the first reference signal terminal, and a drain electrode connected to the first node; and the fourth switch transistor has a gate electrode connected to the light emitting signal terminal, a source electrode connected to the third terminal of the driving control sub-module, and a drain electrode connected to the first terminal of the light emitting device.

19. The organic electroluminescent display panel of claim 18, wherein the light emitting control sub-module comprises a third switch transistor and a fourth switch transistor, and wherein the third switch transistor has a gate electrode connected to the light emitting signal terminal, a source electrode connected to the first reference signal terminal, and a drain electrode connected to the first node; and the fourth switch transistor has a gate electrode connected to the light emitting signal terminal, a source electrode connected to the third terminal of the driving control sub-module, and a drain electrode connected to the first terminal of the light emitting device.

20. The organic electroluminescent display panel of claim 8, wherein when the driving transistor is a P-type transistor, the voltage of the first reference signal terminal is greater than the voltage of the second reference signal terminal; and when the driving transistor is a N-type transistor, the voltage of the first reference signal terminal is less than the voltage of the second reference signal terminal.

* * * * *